United States Patent [19]

Takihara

[11] Patent Number: 4,534,610

[45] Date of Patent: Aug. 13, 1985

[54] JACK

[75] Inventor: Yukio Takihara, Kaizuka, Japan

[73] Assignee: Hosiden Electronics Co., Ltd., Osaka, Japan

[21] Appl. No.: 580,301

[22] Filed: Feb. 15, 1984

[30] Foreign Application Priority Data

Mar. 4, 1983 [JP] Japan ..... 58-32049[U]

[51] Int. Cl.[3] ..... H01R 13/187

[52] U.S. Cl. ..... 339/206 P; 339/59 M; 339/61 M; 339/63 M; 339/259 R

[58] Field of Search ..... 339/206 R, 206 P, 176 R, 339/176 M, 59 R, 59 M, 61 R, 61 M, 63 R, 63 M, 259 R

[56] References Cited

U.S. PATENT DOCUMENTS

| | | | |
|---|---|---|---|
| 2,824,183 | 2/1958 | Marasco et al. | 339/61 R |
| 3,808,578 | 4/1974 | Hansen | 339/59 M |
| 4,449,773 | 5/1984 | Esser et al. | 339/59 M |
| 4,476,400 | 10/1984 | Jo et al. | 339/259 R |
| 4,493,526 | 1/1985 | Masuda | 339/259 R |

*Primary Examiner*—Gil Weidenfeld
*Assistant Examiner*—Thomas M. Kline
*Attorney, Agent, or Firm*—Pollock, Vande Sande and Priddy

[57] ABSTRACT

A jack has a body of insulating synthetic resin having a bore for the insertion and removal of a plug, the body housing a contact member having a movable portion. When the plug is inserted through the bore into the body, the movable portion of the contact member is engaged by the plug for resilient contact therewith. A resilient projection extends integrally from the body and is disposed between the back of the movable portion of the contact member and an inner wall surface of the body. When the movable portion of the contact member is displaced in response to insertion of the plug, the movable portion is brought into resilient contact with the resilient projection which then strengthens the resiliency of the contact member.

5 Claims, 6 Drawing Figures

JACK

BACKGROUND OF THE INVENTION

The present invention relates to a small-size jack.

As electronic devices are becoming smaller in size, there have been growing demands for smaller-size electronic parts and components. One example of such an electronic component is a jack, which has a contact member that will be of poor durability if the size of the jack is reduced. More specifically, a smaller-size jack has a reduced depth which requires a shorter contact member for contact with a plug inserted in the jack. When the plug is inserted in the jack, the end of the contact member is resiliently bent by the plug. As the plug is repeatedly inserted and pulled out, the short contact member is repeatedly bent and undergoes localized deformation. The contact member will then be liable to be broken off relatively easily, and therefore has a relatively short service life.

One solution to the above problem is to reduce the thickness of the contact member thereby to enlarge the area thereof which will be deformed by the inserted plug. Stated othewise, the reduced thickness of the contact member allows the latter to flex bodily for increased durability of the contact member. However, the thin contact member exhibits less resilient force and suffers from the problem of a reduced pressure of contact with the plug. When the contact member and the plug are brought into contact with each other under reduced pressure, no good electric contact is achieved between the contact member and the plug. Another problem with the less resilient contact member is that the plug cannot be retained in the jack with a sufficient retentive force, and will easily be pulled out when the cord connected to the plug is subjected to small tension. In addition, when the plug is inserted in the jack, the user fails to get a tactile assurance that the plug is properly inserted in the jack.

To avoid the above drawbacks, there have been proposed a jack including a coil spring interposed between the movable end of a contact member and a body, as disclosed in U.S. Pat. No. 3,536,870 issued on Oct. 27, 1970 and Japanese Laid-Open Utility Model Publication No. 52–95085. Use of such a coil spring however results in an increased number of parts making up the jack. The disclosed jack is subjected to limitations on smaller designs since it is awkward to assemble the contact member and the coil spring in a required interrelationship into the small body.

The conventional small-size jacks have also been disadvantageous in that a plug tends to be inserted into and pulled out of the jack obliquely to a normal position, with the result that the contact member will be subjected to excessive bending by the plug resulting in permanent deformation and the jack will become defective. To cope with this shortcoming, Japanese Laid-Open Utility Model Publication No. 53-24891 and Japanese Utility Model Publication No. 56-39185 disclose a jack including a body having an integral projection that serves as a stop for receiving a contact member at a suitable angle. More specifically, when a movable portion of the contact member is displaced to a certain extent by a plug inserted into the jack, the back of the contact member which is opposite to the surface held against the plug is brought into abutment against the projection, so that the movable portion of the contact member will not be displaced farther. The projection however serves only to prevent the permanent deformation of the contact member, and is not effective in strengthening the resiliency of the contact member. The proposed jack thus includes a coil spring for assisting the contact member in becoming satisfactorily resilient, as shown in the aforementioned Publication No. 53-24891.

SUMMARY OF THE INVENTION

It is an object of the present invention to provide a jack which is small in size, has a long service life, is capable of good electric contact with a companion plug, can retain the plug with a relatively strong retentive force, and gives the user a definite feel or tactile assurance when the plug is inserted or pulled out.

According to the present invention, a resilient projection extends integrally from a body of an insulating material toward the back of a movable portion of a contact member in a jack, or toward the surface of the contact member which is opposite to the surface that contacts a plug inserted in the jack. The resilient projection extends substantially along, and is shaped in conformity with the shape of, the back of the movable portion of the contact member and is positioned closely to or in confronting relation to the movable portion of the contact member for reinforcing the resiliency of the contact member.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
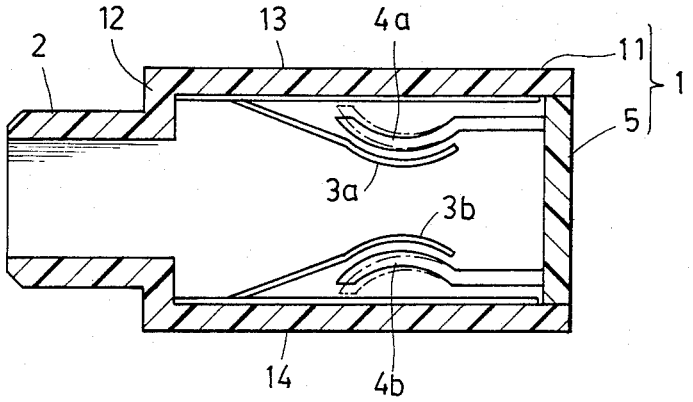
FIG. 1 is a longitudinal cross-sectional view schematically illustrative of a jack according to the present invention.

FIG. 1 shows a jack constructed in accordance with one embodiment of the present invention. The Jack comprises a box-shaped body 1 made of insulating synthetic resin and composed of a main body 11 and a lid plate 5. The main body 11 includes an end plate 12 having a sleeve 2 communicating with the interior of the body 1 and having a bore for the insertion and removal of a plug (not shown) therethrough. The main body 11 has an open end opposite to the end plate 12 which is closed by the lid plate 5. The main body 11 also includes a pair of opposite side plates 13, 14 having a pair of contact members 3*a*, 3*b* extending into the interior of the main body 11 in a direction away from the end plate 12 obliquely toward each other and the lid plate 5. The contact members 3*a*, 3*b* have movable portions which are arcuate in shape and positioned for contact with the plug.

According to the present invention, the body 1 has a pair of integral resilient projections 4*a*, 4*b* of resilient material extending toward the end plate 12 behind the backs of the movable portions of the contact members 3*a*, 3*b*, that is, adjacent to the surfaces of the contact members 3*a*, 3*b* which are opposite to the surfaces thereof that contact the plug. In the embodiment shown in FIG. 1, the resilient projections 4*a*, 4*b* comprise plate-like members projecting integrally from the inner surface of the lid plate 5. By mounting the lid plate 5 in the open end of the main body 11, the resilient projections 4*a*, 4*b* are inserted between the contact members 3*a*, 3*b* and the side plates 13, 14 of the main body 11. The resilient projections 4*a*, 4*b* have surfaces that are shaped to extend closely to and substantially along the backs of the movable portions of the contact members 3*a*, 3*b*.

The movable portions of the contact members 3*a*, 3*b* are normally positioned out of contact with the confronting surfaces of the resilient projections 4*a*, 4*b* and closely to the central axis of the body 1 along which the plug will be inserted and pulled out. When the plug is inserted through the sleeve 2 into the body 1, the movable portions of the contact members 3*a*, 3*b* are pressed by the plug away from each other against the resilient projections 4*a*, 4*b*, respectively and then push the resilient projections 4*a*, 4*b* toward the side plates 13, 14, respectively, as shown by the dotted lines in FIG. 1. At this time, the contact members 3*a*, 3*b* are held in contact with the inserted plug with a sufficient contact pressure under their own resiliency and the resiliency of the resilient projections 4*a*, 4*b*. The contact members 3*a*, 3*b* and the plug are now in good electric contact with each other. The contact pressure is also imposed on a neck portion of the inserted plug so that the plug can be retained in the body 1 of the jack under a strong retentive force and the user can have a definite feel at the time the plug is inserted in or pulled out of the body 1 of the jack. Since the contact members 3*a*, 3*b* are assisted by the resilience forces from the resilient projections 4*a*, 4*b*, the contact members 3*a*, 3*b* may be of a reduced thickness and have a long service life.

Figure 2:
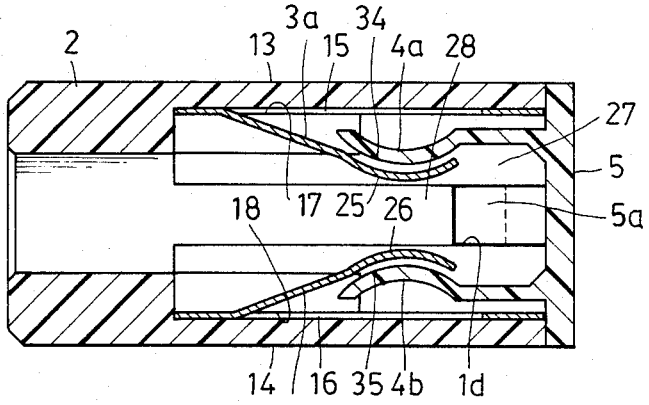
FIG. 2 is a longitudinal cross-sectional view showing the jack in greater detail.
Figure 3:
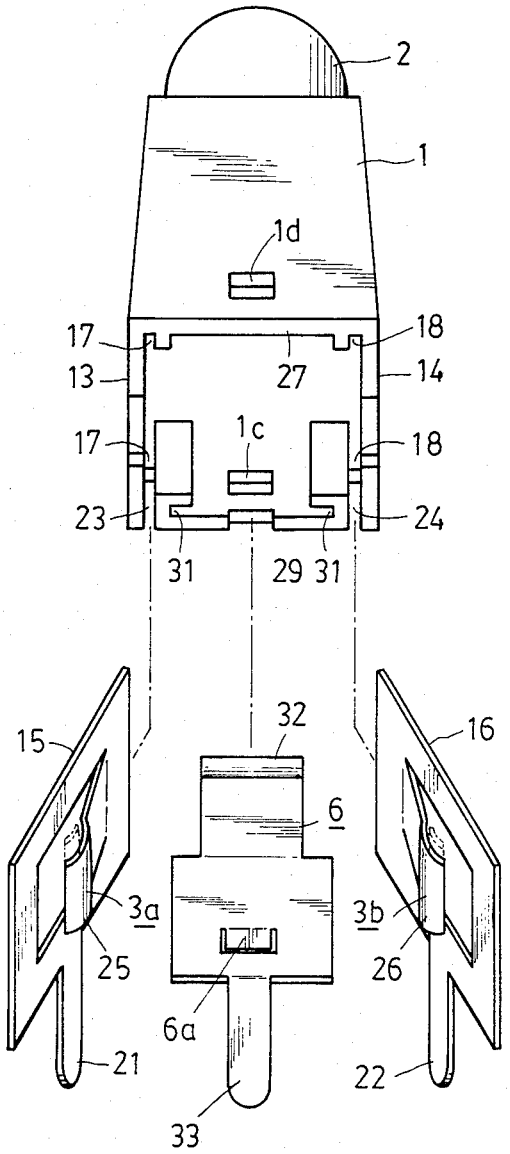
FIG. 3 is an exploded perspective view of the jack shown in FIG. 2, with a lid body omitted from illustration.

The jack according to the present invention is illustrated in greater detail in FIGS. 2 through 5. As shown in FIGS. 2 and 3, the contact members 3*a*, 3*b* are formed by slitting resilient plates of electrically conductive metal. With the contact members 3*a*, 3*b* thus formed, the plates are in the form of rectangular frames 15, 16 which are inserted into the main body 11 through the open end thereof along the inner surfaces of the side plates 13, 14. The rectangular frames 15, 16 have opposite side edges fitted in guide slots 17, 18 defined in the main body 11 along the side plates 13, 14. The rectangular frames 15, 16 include respective integral terminals 21, 22 projecting from one side edges thereof. The terminals 21, 22 are inserted through slits 23, 24, respectively, defined in the main body 11 and extending from the open end thereof along the side plates 13, 14. The contact members 3*a*, 3*b* are joined to the rectangular frames 15, 16 at ends thereof closer to the sleeve 2. The contact members 3*a*, 3*b* have distal free end portions 25, 26 which are formed as arcuately curved members that face each other and extend toward each other distal free end portions 25, 26 are in resilient engagement with a ridge 28 whose width is less than that of the diameter of the insertion bore in sleeve 2 and less than the diameter of a plug to be inserted into said insertion bore, the ridge 28 being integrally formed with a side plate 27 extending between the side plates 13, 14, and the ridge 28 being resiliently nipped at opposite sides thereof by the curved distal end portions 25, 26 thereby providing biasing forces. It is also possible to provide the marginal side portions of the movable portions 25, 26 with tabs for engagement with the ridge 28 as indicated by broken lines in FIG. 3.

Figure 4:
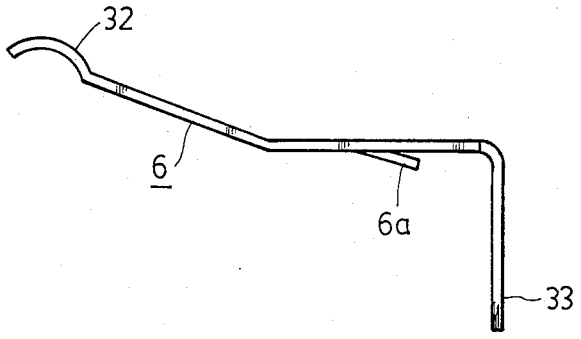
FIG. 4 is a front elevational view of a grounding contact member in the jack shown in FIG. 3.

As illustrated in FIG. 3, a grounding contact 6 is disposed on and along the inner surface of a side plate 29 extending between the side plates 13, 14 in spaced relation to the side plate 27. The grounding contact 6 has a wider rear end portion closer to the lid plate 5 and includes opposite side edges that are inserted respectively into slots 31, 31 on the inner surface of the side plate 29. As illustrated in FIGS. 3 and 4, the rear end portion of the grounding contact 6 has a tongue 6*a*, formed by slitting the rear end portion, which projects toward the side plate 29. The tongue 6*a* engages in a hole 1*c* defined in the side plate 29 to prevent the grounding contact 6 from being dislodged from the main body 11. The grounding contact 6 has a front end portion inclined away from the side plate 29 as it approaches toward the sleeve 2. The front end portion of the grounding contact 6 has a distal end serving as an arcuate contact portion 32 for contact with an outer conductor of the plug. The grounding contact 6 has an integral grounding terminal 33 projecting from a rear end thereof.

Figure 5:
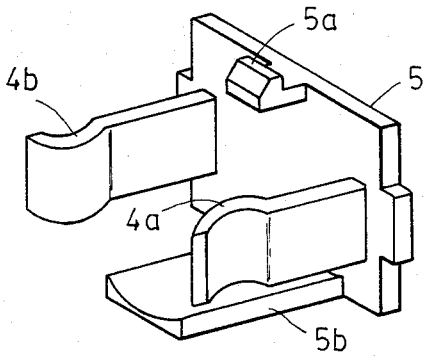
FIG. 5 is a perspective view of the lid body.

As shown in FIGS. 2 and 5, the lid plate 5 has a locking hook 5*a* located adjacent to the side plate 27 of the main body 11 and fitted in a hole 1*d* defined in the side plate 27. The lid plate 5 also has a presser member 5*b* integrally projecting therefrom adjacent to the side plate 29. The locking hook 5*a* and the presser member 5*b* jointly serve to prevent the lid plate 5 from being detached from the open end of the main body 11. The plate-shaped resilient projections 4*a*, 4*b* project integrally from the inner surface of the lid plate 5 at opposite sides thereof. When the lid plate 5 is mounted in the open end of the main body 11, the resilient projections 4*a*, 4*b* are inserted between the contact members 3*a*, 3*b* and the side plates 15, 16. The resilient projections 4*a*, 4*b* have arcuately curved portions 34, 35, respectively, extending in confronting relation to and substantially along the backs of the movable portions 25, 26 of the contact members 3*a*, 3*b*. The arcuately curved portions 34, 35 of the resilient projections 4*a*, 4*b* have distal ends lying substantially parallel to the side plates 15, 16, respectively, and spaced therefrom by a gap in the range of 0.1 mm to 0.25 mm, for example. According to one example, the resilient projections 4*a*, 4*b* have a thickness in the range of 0.3 mm to 0.4 mm, a width of about 2.2 mm, and a length of about 3.6 mm; the main body 11 has outer dimensions of 5 mm×5 mm×9 mm; the sleeve 2 has an outside diameter of 5 mm and a length of 3 mm, and the contact members 3*a*, 3*b* have a length of 4.8 mm, a width of 2 mm, and a thickness of 0.2 mm. The rectangular frames 15, 16 are prevented from removal by the lid plate 5 mounted in the open end of the main body 11.

For increased mechanical strength, the main body 11 should preferably be made of glass-reinforced polyimide, for example. The lid plate 5 should preferably be made of polyacetal, for example, to render the projections 4*a*, 4*b* resilient.

With the above construction, the contact members 3*a*, 3*b* are prevented from removal and the resilient projections 4*a*, 4*b* are assembled in place simultaneously simply by inserting the lid plate 5 into the open end of the main body 11. Accordingly, the jack of the present invention can easily be assembled.

Figure 6:
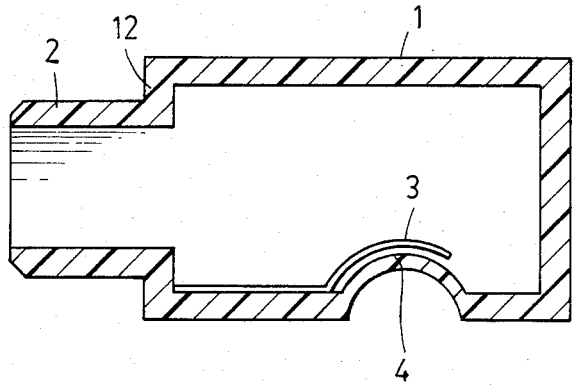
FIG. 6 is a longitudinal cross-sectional view of a jack according to another embodiment of the present invention.

FIG. 6 illustrates a jack according to another embodiment of the present invention. The jack shown in FIG. 6 has a body 1 including a side plate with an integral resilient projection 4. The resilient projection 4 may be rendered resilient by being made thinner than the rest of the body 1 or defining slits in the body 1 one on each side of the projection 4 in a direction in which a plug can be inserted and pulled out. The jack also has a contact member 3 extending closely to and substantially along the resilient projection 4. The jack illustrated in FIG. 6 has one resilient projection and one contact member contacting therewith. Accordingly, the embodiment shown in FIGS. 1 through 5 is not limited to the arrangement in which two contact members are employed.

Where two contact members are used in one jack, their movable portions may be disposed in different positions in the direction in which the plug will be inserted and removed, and resilient projections may be placed adjacent to the staggered movable portions, respectively.

Although certain preferred embodiments have been shown and described, it should be understood that many changes and modifications may be made therein without departing from the scope of the appended claims.

What is claimed is:

1. A jack comprising:

(a) a box-shaped body made of insulating synthetic resin, said body having a rear open end and a front face which is remote from said open end and which has a bore therein for the insertion and removal of a plug;

(b) a lid plate for closing the rear open end of said body;

(c) an elongated contact member having one end thereof fixedly mounted inside said body near said bore at a location that is spaced from the central axis of said bore, said contact member extending from its said fixed end towards said lid plate and being oriented to extend away from an inner wall surface of said body and toward the central axis of said bore, said contact member having a distal end portion which serves as a movable contact portion that is displaceable away from said central axis of said bore when engaged by a plug inserted into said bore; and (d) a resilient projection integral with and projecting from said lid plate, said resilient projection having a free end portion which is disposed between said inner wall surface of said body and said movable contact portion of said contact member while leaving a space between said free end portion and said inner wall surface of said body such that, when said movable contact portion is displaced by the insertion of a plug, said movable contact portion pushes said free end portion of said resilient projection into resilient engagement with said inner wall surface of said body.

2. A jack according to claim 1, wherein said resilient projection extends substantially parallel to a direction in which the plug is inserted into said body.

3. A jack according to claim 2, including a rectangular resilient plate of metal which is slitted to form said contact member and provide a rectangular frame to which said contact member is joined, said rectangular frame being accommodated in said body through said rear open end and retained therein by said lid plate.

4. A jack according to claim 1, wherein said body is made of a resin material having a relatively large mechanical strength, said lid plate being made of a resin material having enough resiliency to render said resilient projection resilient.

5. A jack according to claim 1 including a ridge integrally formed with an inner wall surface of said body, a marginal side portion of said distal end portion of said contact member being held in resilient engagement with said ridge to bias said movable contact portion of said contact member toward said central axis of said bore.

* * * * *